US006892609B2

(12) United States Patent
Kuo

(10) Patent No.: US 6,892,609 B2
(45) Date of Patent: May 17, 2005

(54) PLIERS WITH MOVABLE JOINT

(75) Inventor: Teng-Hsien Kuo, Taipei Hsien (TW)

(73) Assignee: King Lugger Inc., Taipei Hsien (TW)

( * ) Notice: Subject to any disclaimer, the term of this patent is extended or adjusted under 35 U.S.C. 154(b) by 0 days.

(21) Appl. No.: 10/430,321

(22) Filed: May 7, 2003

(65) Prior Publication Data

US 2004/0221694 A1 Nov. 11, 2004

(51) Int. Cl.[7] ..... B25B 7/04
(52) U.S. Cl. ..... 81/413; 81/409.5; 81/411
(58) Field of Search ..... 81/413, 412, 411, 81/338, 405, 407, 408, 409.5

(56) References Cited

U.S. PATENT DOCUMENTS 957,560 A * 5/1910 Holt ..... 81/412
1,076,133 A * 10/1913 Manier ..... 81/409.5
1,236,138 A * 8/1917 Bernard ..... 81/412
1,565,210 A * 12/1925 Seiber ..... 81/409.5
4,269,089 A * 5/1981 Hastings ..... 81/409.5
4,438,669 A * 3/1984 Hastings et al. ..... 81/409.5
4,581,960 A * 4/1986 Putsch et al. ..... 81/411
4,669,340 A * 6/1987 Igarashi ..... 81/416
4,719,827 A * 1/1988 Igarashi ..... 81/417
5,020,399 A * 6/1991 Annis et al. ..... 81/358
5,291,810 A * 3/1994 Lins ..... 81/414
5,845,551 A * 12/1998 Putsch ..... 81/412
5,887,495 A * 3/1999 Kao ..... 81/358
6,000,303 A * 12/1999 Chang ..... 81/341
6,081,952 A * 7/2000 Haxton ..... 7/107
6,199,459 B1 * 3/2001 Azkona ..... 81/411
6,467,380 B1 * 10/2002 Azkona ..... 81/413
6,694,848 B1 * 2/2004 Flavigny ..... 81/413

* cited by examiner

*Primary Examiner*—A. L. Wellington
*Assistant Examiner*—Ali Abdelwahed
(74) *Attorney, Agent, or Firm*—Rabin & Berdo, P.C.

(57) ABSTRACT

A pair of pliers mainly includes a first body part having predetermined length, thickness, and shape; a second body part having length, thickness, and shape adapted to work with that of the first body part; and a joint pivotally connecting the first and the second body part together at a predetermined position. The joint is movable within a defined range to enable quick adjustment of jaw opening of the pliers, and is locked in place once it is moved to a desired position.

5 Claims, 9 Drawing Sheets

PLIERS WITH MOVABLE JOINT

FIELD OF THE INVENTION

The present invention relates to a pair of pliers used mainly as a hand tool. The pliers may be quickly adjusted to a desired jaw opening through a movable and anti-return joint pivotally connecting two body parts of the pliers to each other.

BACKGROUND OF THE INVENTION

FIG. 1 shows a first type of conventional pliers that is typically referred to as fixed type pliers because it includes a first body part 10 and a second body part 20 that are pivotally connected together at a fixed joint by means of a bolt or rivet. This type of pliers has the advantages of having less number of constituent elements and relatively simple structure, but the disadvantage of being inconvenient for use. For instance, when this fixed type of pliers is used to clamp an article having a large diameter, two jaws at front portions of the first and the second body part 10, 20 are widely opened to hold the article between them while a first handle 13 and a second handle 25 at rear portions of the two body parts 10, 20, respectively, are widely separated from each other at the same time. A user has to grip at the first handle 13 with one hand and the second handle 25 with the other hand to keep the pliers in a stable working position. It is desirable to improve the fixed type of pliers for the user to handle it more conveniently.

FIG. 2 shows a second type of conventional pliers having a push button A1 for adjusting a position at where a joint pivotally connecting two body parts of the pliers together is located. To use the pliers, the user has to hold down the push button A1 with one hand to enable moving of the joint with the other hand.

FIG. 3 shows a third type of conventional pliers being provided with an adjusting mechanism including a plurality of curved engaging grooves B1. The curved engaging grooves B1 provide different positions for a joint of the pliers to selectively engage therewith. However, it is known this type of pliers is usually used in a construction site, and thus requires a relatively strong structure to bear any applied force. To meet this structural requirement, the curved engaging grooves B1 must not be too closely spaced from one another and therefore could not provide highly precise adjustment of the joint in its position.

It is therefore desirable to develop a pair of pliers to improve the conventional pliers that are not quickly and precisely adjustable in their jaw openings.

SUMMARY OF THE INVENTION

A primary object of the present invention is to provide a pair of pliers that includes a movable and anti-return joint for quickly adjusting a jaw opening of the pliers.

Another object of the present invention is to provide a pair of pliers that includes a movable and anti-return joint, on which a rack having fine and strong teeth is provided to mesh with another rack provided on a body part of the pliers, so as to enable precise adjustment of the joint in its position to change the jaw opening of the pliers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
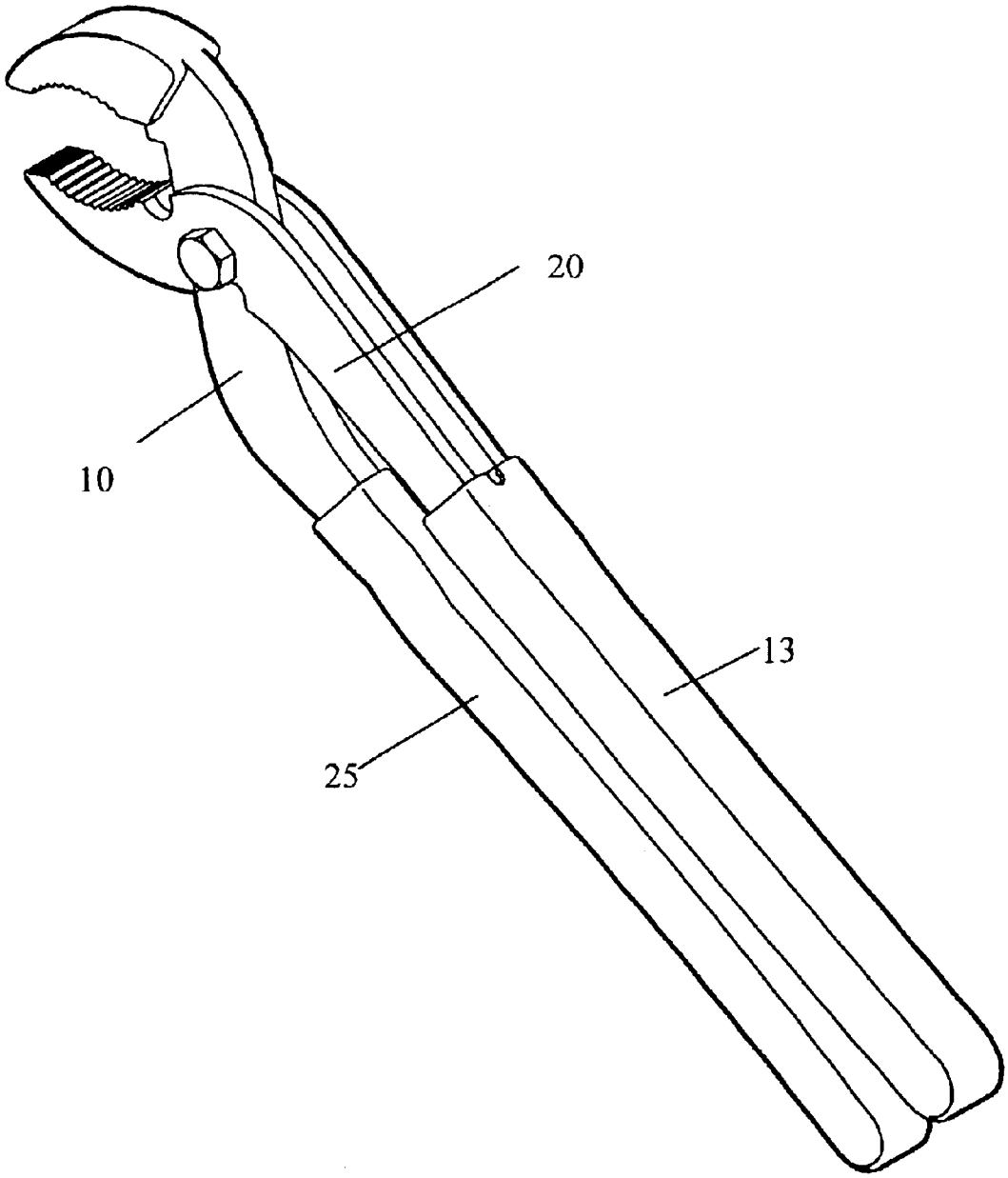
Fig. 1 (Prior Art)
FIG. 1 is a perspective view of a first type of conventional pliers.
Figure 2:
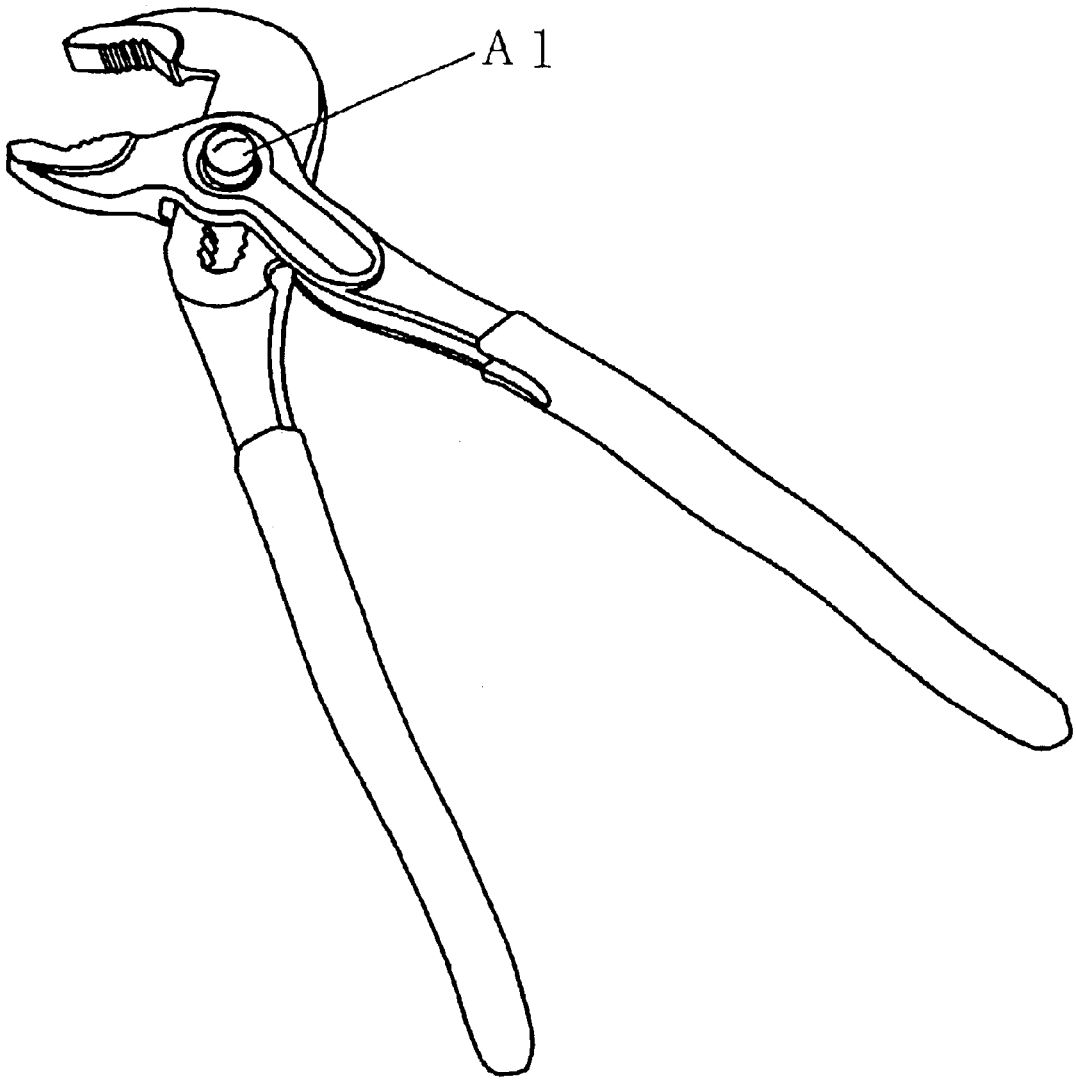
Fig. 2 (Prior Art)
FIG. 2 is a perspective view of a second type of conventional pliers.
Figure 3:
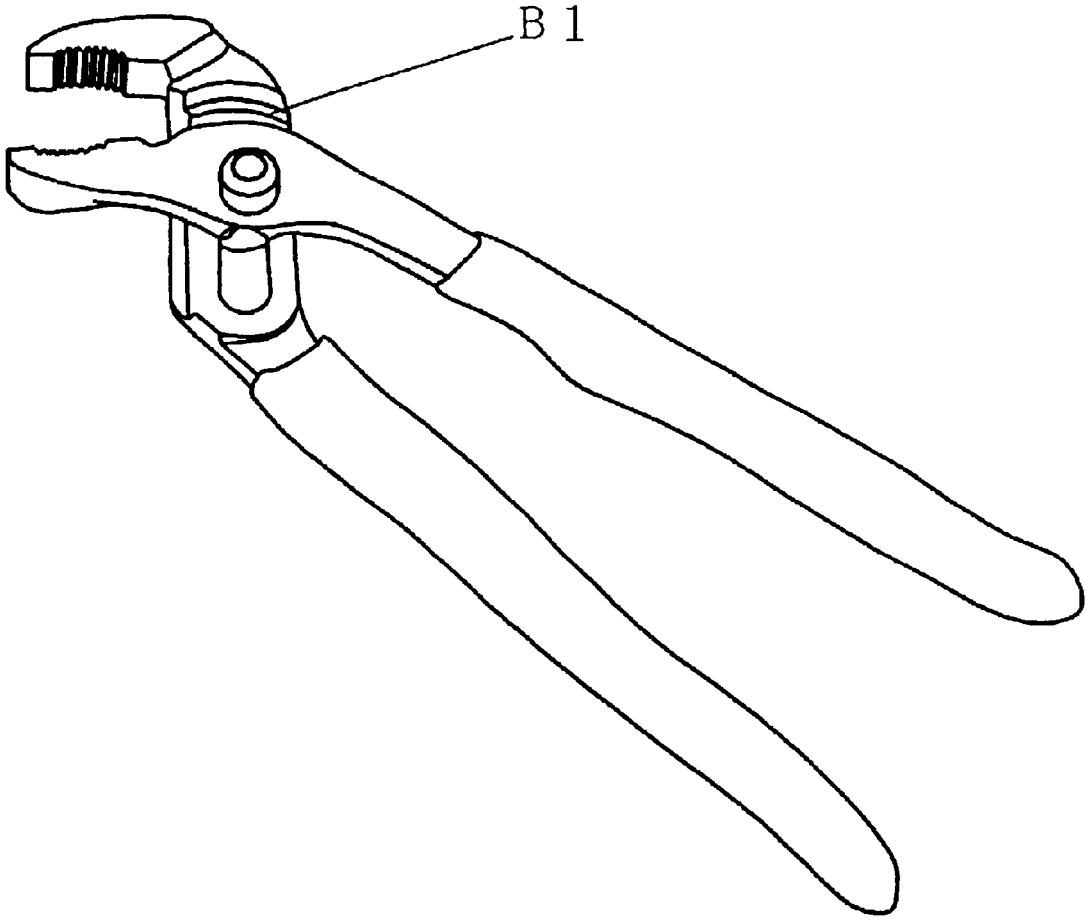
Fig. 3 (Prior Art)
FIG. 3 is a perspective view of a third type of conventional pliers.
Figure 4:
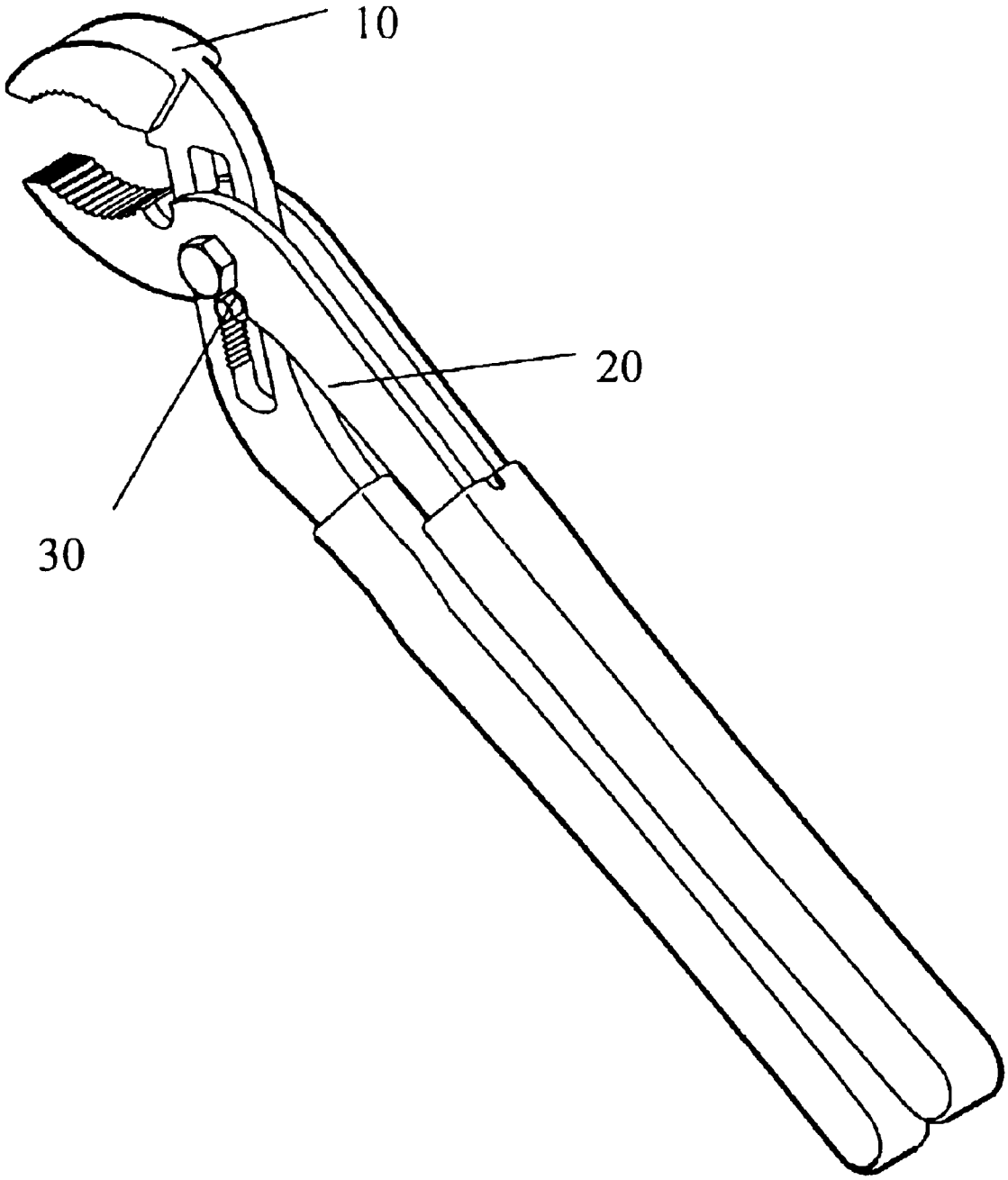
FIG. 4 is an assembled perspective view of a pair of pliers according to a preferred embodiment of the present invention.
Figure 5:
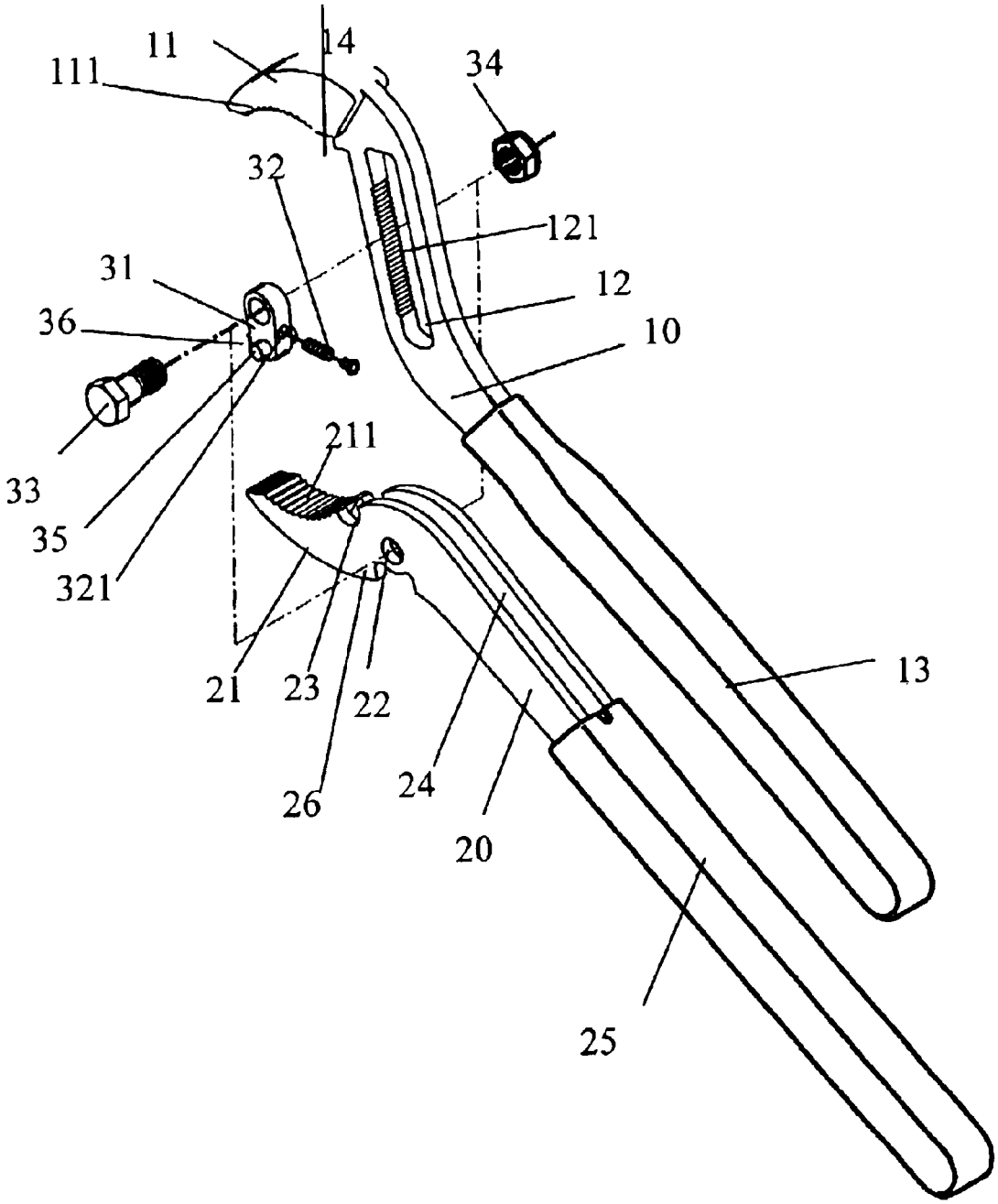
FIG. 5 is an exploded perspective view of FIG. 4.

Please refer to FIGS. 4 and 5 that are assembled and exploded perspective views, respectively, of a pair of pliers according to a preferred embodiment of the present invention. As shown, the pliers mainly include a first body part 10 having predetermined length, thickness and shape, a second body part 20 having length, thickness shape corresponding to that of the first body part 10, and an anti-return joint 30 pivotally connecting the first and the second body parts 10, 20 together. The first body part 10 is provided at a front portion with a first jaw 11 having a toothed portion 111 provided at an inner side thereof, and the second body part 20 is provided at a front portion with a second jaw 21 having a toothed portion 211 provided at an inner side thereof corresponding to the toothed portion 111, so that an article may be firmly and stably clamped between the too toothed portions 111, 211.

A middle portion of the first body part 10 behind the first jaw 11 is provided with a long slot 12 having a first rack 121 provided at one longitudinal inner wall of the slot 12. A rear portion of the first body part 10 is a first handle 13. A middle portion of the second body part 20 behind the second jaw 21 is provided with a long receiving space (groove) 24 for the middle portion of the first body part 10 to extend therethrough. An internally threaded hole 22 is provided on the middle portion of the second body part 20 closely behind the second jaw 21, and a press head 26 is formed below the threaded hole 22. A rear portion of the second body part 20 is a second handle 25.

Figure 6:
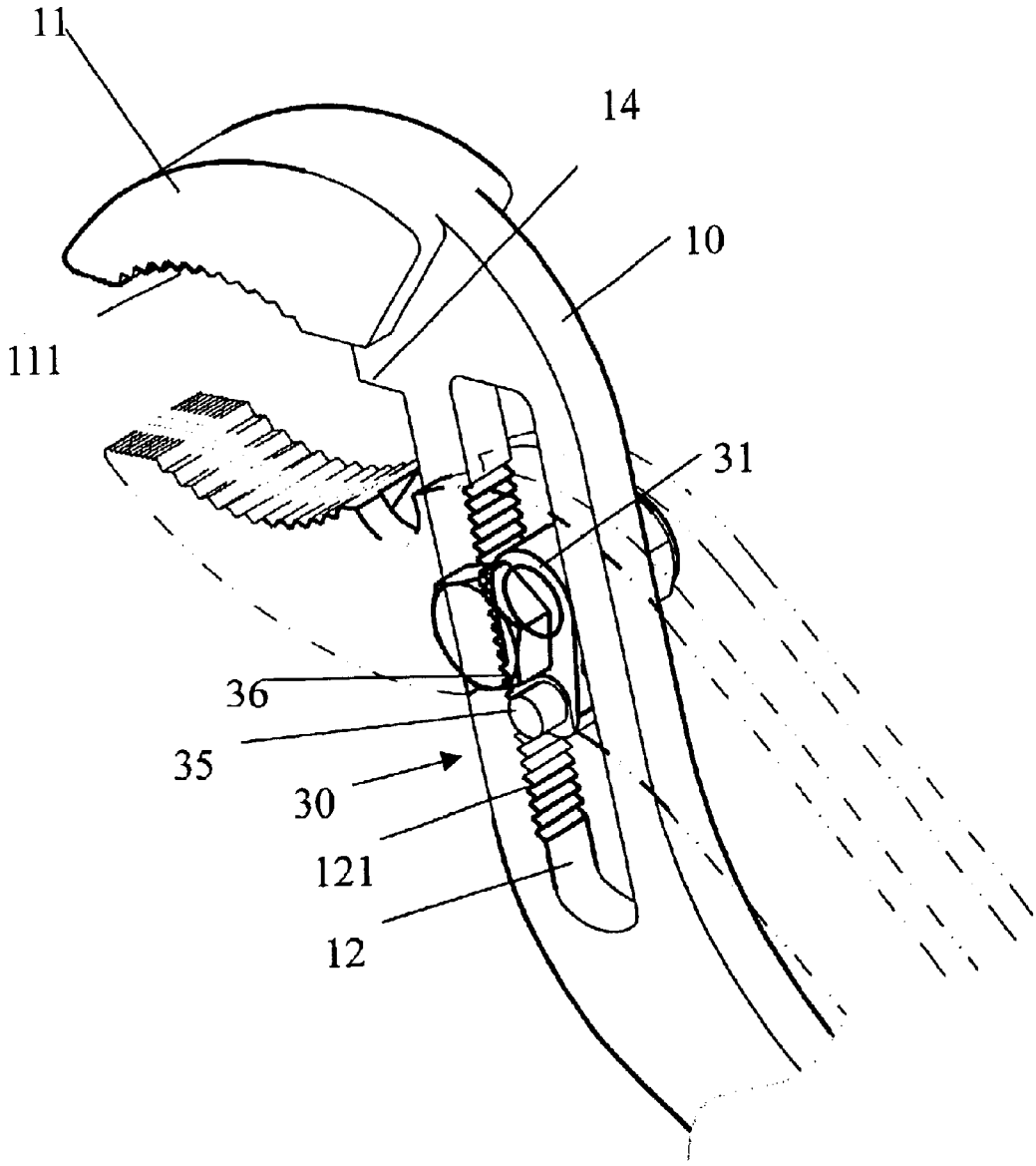
FIG. 6 is a fragmentary and enlarged perspective view showing a detailed structure of the pliers of the present invention.

The anti-return joint 30 includes a main body 31 having an internally threaded hole 311 formed at an upper portion thereof, a spring 32 having a first end fixedly mounted in a spring hole 321 formed at one lateral side of the main body 31, a bolt 33 adapted to extend through the threaded hole 311, a nut 34 adapted to engage with the bolt 33 after the latter is extended through the threaded hole 311, a stub 35 provided at one side of a lower portion of the main body 31 below the threaded hole 311, and a second rack 36 provided on an outer wall surface of the main body 31 opposite to the spring 32. The anti-return joint 30 is located in the long slot 12 of the first body part 10 with the second rack 36 meshing with the first rack 121 and a second end of the spring 32 pressed against an inner wall surface of the long slot 12 opposite to the first rack 121. With the spring 32 normally elastically pressed the second end against the inner wall of the long slot 12, the second rack 36 on the main body 31 of the anti-return joint 30 is kept firmly meshing with the first rack 121 at a selected position to prevent the main body 31 from moving, as shown in FIG. 6.

To pivotally connect the first body part 10 to the second body part 20 with the anti-return joint 30, the bolt 33 is sequentially extended through an end of the threaded hole 22 on the second body part 20, the threaded hole 311 on the anti-return joint 30, and the other end of the threaded hole 22 to engage with the nut 34.

Figure 7:
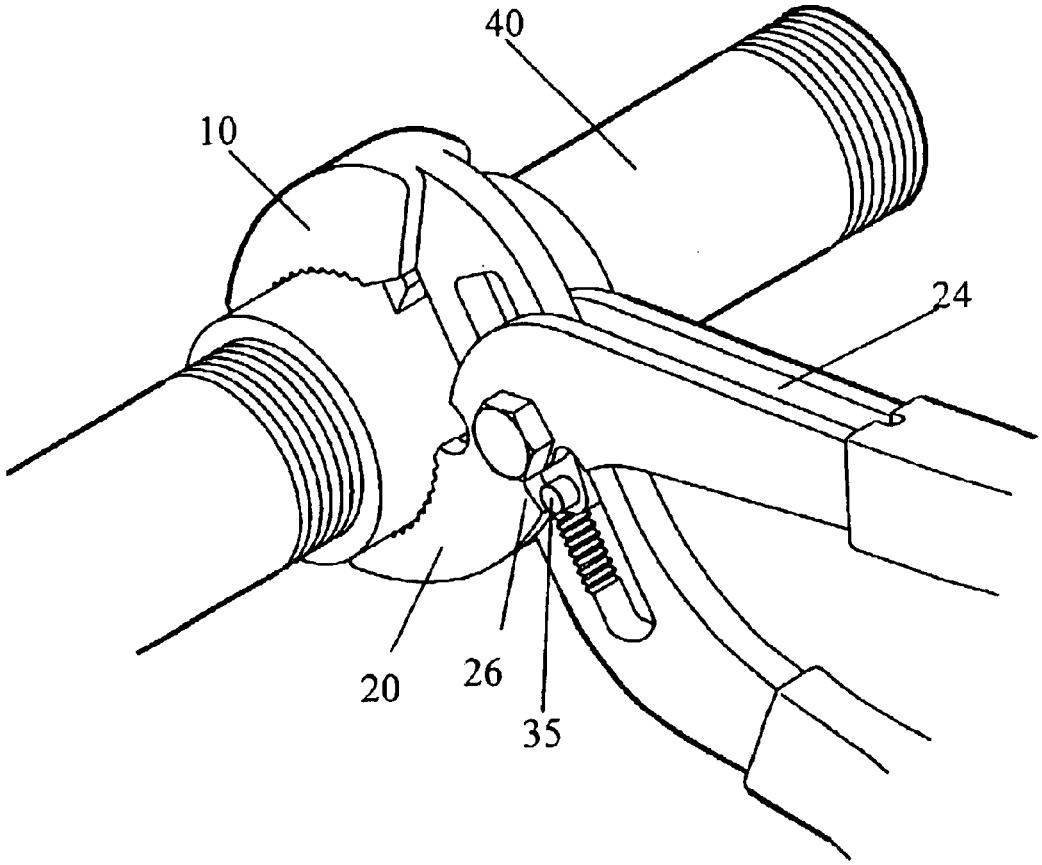
FIG. 7 shows a first manner of adjusting the pliers of the present invention.

FIG. 7 shows a first manner of adjusting the pliers of the present invention. For example, when it is desired to use the pliers to clamp a water pipe 40 having a relatively large diameter, first adjust an opening between the first and the second jaw 11, 21 by slowly separating the first and the second handle 13, 25 apart. At this point, the press head 26 on the second body part 20 would become in contact with the stub 35 to rearward drive the main body 31 of the anti-return joint 30 and thereby compresses the spring 32 located between the main body 31 and the inner wall of the long slot 12. The compression of the spring 32 allows the second rack 36 on the main body 31 of the anti-return joint 30 to only loosely engage with the first rack 121 on the inner wall of the long slot 12 of the first body part 10. At this point, the second handle 25 may be lightly moved along the long slot 12 to a desired position and accordingly adjust the opening between the first and the second jaw 11, 21.

Figure 8:
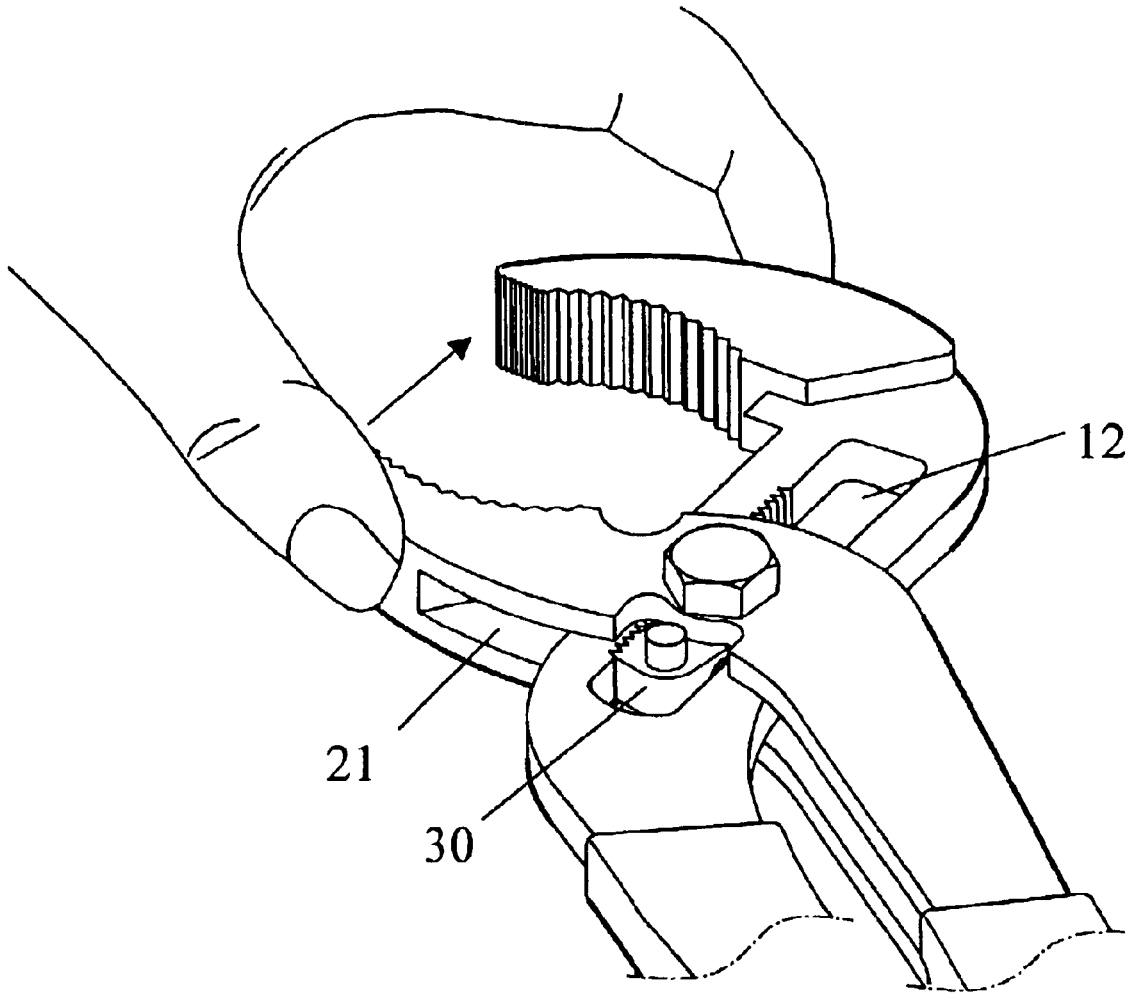
FIG. 8 shows a second manner of adjusting the pliers of the present invention.

FIG. 8 shows a second manner of adjusting the pliers of the present invention. In this second manner, the first and the second handle 13, 25 are kept in contact with each other, as the case shown in FIG. 4, and the second jaw 21 is lightly moved toward the first jaw 11.

Figure 9:
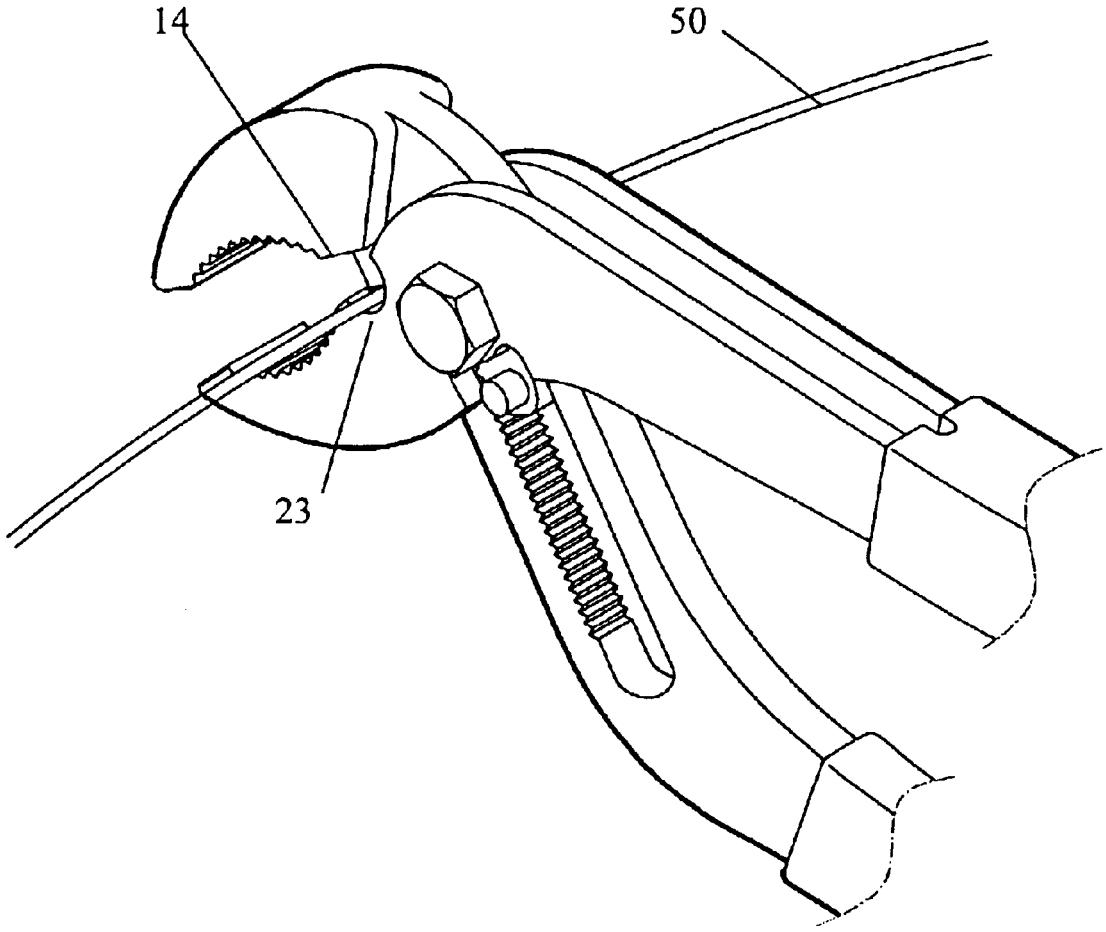
FIG. 9 shows an example of application of the pliers of the present invention.

Please refer to FIG. 9. The pliers of the present invention are correspondingly provided at inner ends of the first and the second jaw 11, 21 with a first blade 14 and a second blade 23, respectively. The first and the second blade 14, 23 together functions like a pair of scissors to easily cut, for example, a wire 50.

The present invention has been described with a preferred embodiment thereof and it is understood that many changes and modifications in the described embodiment can be carried out without departing from the scope and the spirit of the invention as defined by the appended claims.

What is claimed is:

1. A pair of pliers, comprising:

a first body part having a first jaw, a first handle, and a first middle portion disposed between the first jaw and the first handle, the first middle portion having a long slot formed therein, the middle portion further having a first toothed rack disposed along one side of the long slot;

a second body part having a second jaw, a second handle, and a second middle portion disposed between the second jaw and the second handle, the second middle portion having a groove formed therein, which receives the first body part therein, and a fastener receiving hole; and an anti-return joint, having:

a main body slidably disposed in the long slot of said first body part, the main body having a second toothed rack along one edge thereof that is engagable with the first toothed rack, to prevent the main body from sliding in the long slot, said main body also including a spring hole disposed in another edge thereof that is opposite to the one edge;

a fastener that extends through the fastener receiving hole of said second body part, and through a through hole of the main body, to pivotally couple said second body part to said anti-return joint and said first body part; and a spring having one end disposed in the spring hole, and another end that presses against another side of the long slot that is opposite to the one side, the spring urging the second toothed rack into engagement with the first toothed rack;

wherein an opening between said first jaw and said second jaw is adjusted by pivoting said main body against the urging of the spring, to disengage the second toothed rack from the first toothed rack, thereby allowing said anti-return joint to be slid in the long slot, and causing the first jaw to move closer to or away from the second jaw and wherein said second body part further has a press head disposed at the second middle portion, and the main body includes a stub, wherein said pliers are adjustable by separating said first handle and said second handle, thereby causing the press head to engage with the stub to move the main body, and thereby disengaging the second toothed rack from the first toothed rack.

2. The pair of pliers recited in claim 1, wherein said first jaw has a first toothed portion.

3. The pair of pliers recited in claim 2, wherein said second jaw has a second toothed portion.

4. The pair of pliers recited in claim 1, wherein said first jaw has a first cutting blade.

5. The pair of pliers recited in claim 4, wherein said second jaw has a second cutting blade.

* * * * *